US006659443B1

(12) United States Patent
Eskey

(10) Patent No.: US 6,659,443 B1
(45) Date of Patent: Dec. 9, 2003

(54) IMAGING APPARATUS AND METHODS

(75) Inventor: Eric Unger Eskey, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/147,251

(22) Filed: May 15, 2002

(51) Int. Cl.[7] ..... B65H 3/44

(52) U.S. Cl. ..... 271/9.08; 271/9.12; 271/9.11; 271/162; 271/9.03

(58) Field of Search ..... 271/9.05, 9.07, 271/9.08, 9.11, 9.12, 126, 160, 162

(56) References Cited

U.S. PATENT DOCUMENTS 3,989,236 A * 11/1976 Komori et al. ..... 271/4.1
5,076,562 A * 12/1991 Sai et al. ..... 271/9.08
5,102,112 A * 4/1992 Takahashi ..... 271/9.08
6,431,537 B1 * 8/2002 Meier ..... 271/9.01
6,547,234 B1 * 4/2003 Quesnel ..... 271/9.08

FOREIGN PATENT DOCUMENTS

JP 03143845 A * 6/1991 ..... B65H/3/44

* cited by examiner

*Primary Examiner*—Donald P. Walsh
*Assistant Examiner*—Kaitlin Joerger

(57) ABSTRACT

Apparatus and methods for selectively picking two or more types of imaging media in an imaging apparatus having only a single pick roller while simultaneously supporting each type of imaging media on the imaging apparatus, wherein such media is ready for picking. The imaging media can be supported in respective media trays while supported on the imaging apparatus. The apparatus includes an actuating mechanism that is configured to selectively position each of the media trays relative to the pick roller, one-at-a-time, to facilitate picking by the pick roller of the selected imaging media. Methods include simultaneously supporting a plurality of types of imaging media on an imaging device having a single pick roller, and selectively picking either the first imaging media or the second imaging media from the respective media tray.

11 Claims, 4 Drawing Sheets

IMAGING APPARATUS AND METHODS

FIELD OF THE INVENTION

The invention claimed and disclosed herein pertains to imaging apparatus and methods, and more specifically, to apparatus and methods for supporting multiple types of imaging media on an imaging device having only one pick roller.

BACKGROUND OF THE INVENTION

Various forms of imaging devices are known in the art. Imaging devices are those devices that are configured to produce an image on an imaging media. Imaging devices are known by various names in accordance with specific applications thereof, which include those of printers, facsimile machines, photocopiers, and the like. Imaging devices can also include integral units (commonly known as "all-in-one" devices) which combine the functionality of two or more of the aforementioned exemplary imaging devices. Imaging media that is used in conjunction with the production of images is generally in the form of paper sheets, but can be in other forms such as plastic transparency sheets, envelopes, cardstock, and labels. In order to form an image, an imaging device deposits a substance such as ink, dye, toner, or the like onto the imaging media to form the image.

Prior art imaging devices are generally configured to accept more than one size and/or configuration of the imaging media in order to facilitate versatility of use. For example, a typical prior art imaging device can be configured to accept different sizes of paper sheets, and/or can be configured to accept envelops in addition to letter-sized paper sheets. In general, the more basic economy imaging devices are configured to allow only one form of imaging media to be placed into the imaging device at a time. For example, a basic printer has only one imaging media tray that is adjustable so as to accept different sizes and types of imaging media.

In such a printer having only one media tray, the imaging media must be physically removed and replaced whenever the size or type of media is changed. For example, to print a document, a plurality of letter-sized paper sheets is placed into the media tray of the printer. The document is printed on the letter-sized sheets of paper. Then, to print an address on an envelope, the remaining letter-sized sheets of media are removed from the media tray, and an envelope is placed into the tray. The address is printed on the envelope. In order to print another document, the letter-sized imaging media would again be placed into the media tray of the printer.

Larger, more advanced imaging devices generally include a plurality of media trays for holding various types and/or sizes of imaging media or the like. For example, a typical prior art advanced printer generally has several media trays. In such a printer, one of the media trays is generally configured to hold standard letter-sized paper sheets, while another of the media trays is configured to hold legal-sized paper sheets. Yet another of the media trays can be configured to hold standard-sized envelopes. This type of arrangement can be advantageous because different types of imaging media and envelopes can be utilized in a single imaging device without the need for removal and replacement of the imaging media and/or envelopes each time a different type and/or size of media is called for.

However, with regard to these more advanced prior art imaging devices which employ a plurality of media trays, the media handling means which are configured to accommodate the multiple media trays can be overly complex and can occupy an extra amount of space. For example, such prior art imaging devices having a plurality of media trays employ a separate pick roller, and related drive and control system, for each media tray. In addition, multiple media paths and related media conveyance means are required to move each of the different types of media from the respective media tray to the imaging section where the image is transferred to the media.

What are needed then are imaging apparatus and methods which achieve the benefits to be derived from similar prior art methods and/or devices, but which avoid the shortcomings and detriments individually associated therewith.

SUMMARY OF THE INVENTION

The instant invention provides for supporting two or more types of imaging media on an imaging apparatus having only a single pick roller. That is, in accordance with various embodiments of the present invention, an imaging apparatus can employ a single pick roller to selectively pick one of two or more types of imaging media which are supported in respective media trays. This is accomplished by employing an actuating mechanism that is configured to selectively position any of the media trays relative to the pick roller so that the respective imaging media is presented to the pick roller for picking. These and other aspects and embodiments of the present invention will now be described in detail with reference to the accompanying drawings, wherein:

DETAILED DESCRIPTION OF THE INVENTION

Figure 1:
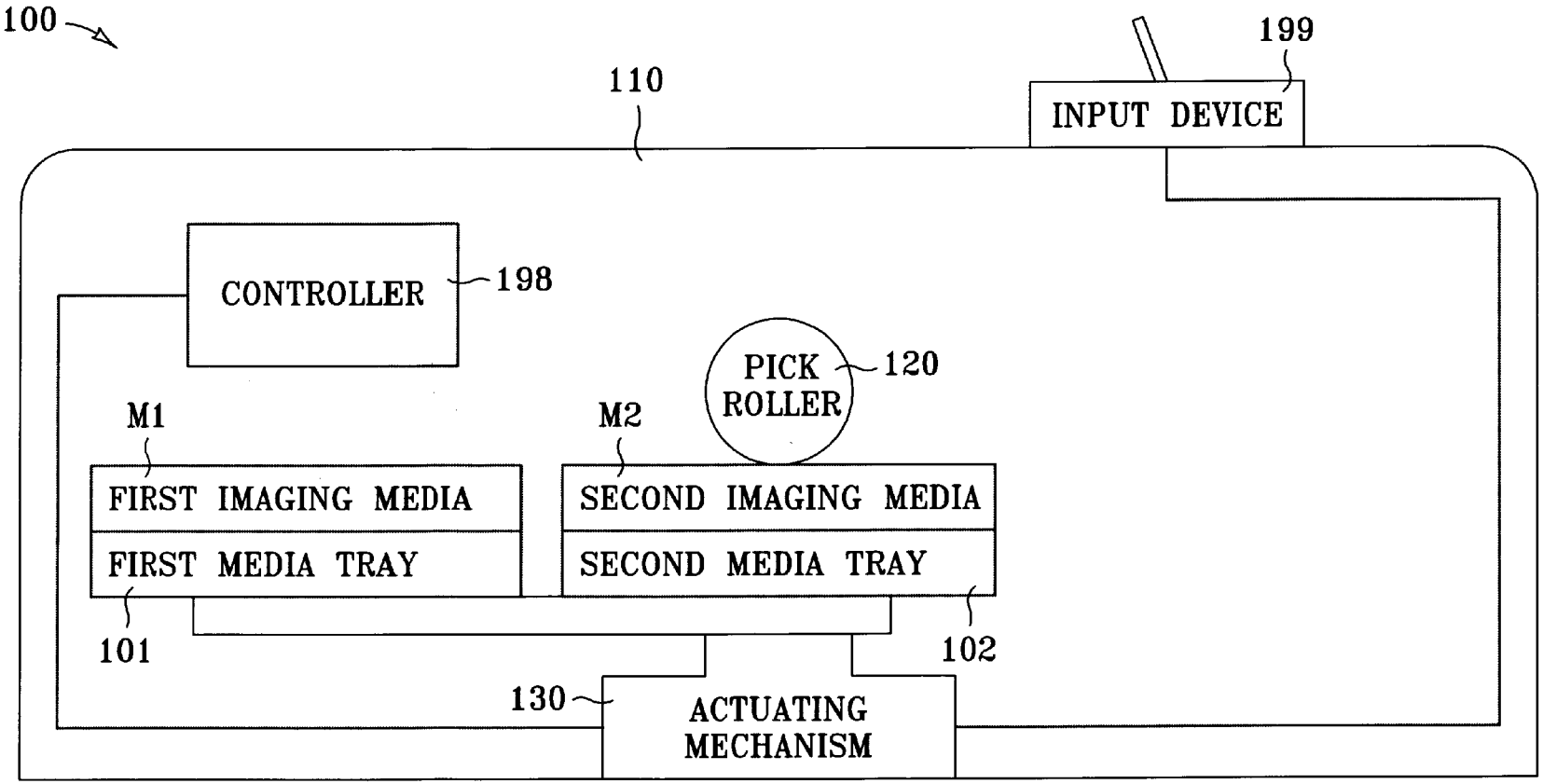
FIG. 1 is a schematic diagram which depicts an imaging apparatus in accordance with one embodiment of the present invention.

Apparatus and methods in accordance with the instant invention provide for supporting multiple types of imaging media in respective media trays which, in turn, are supported on an imaging apparatus having only a single pick roller. Any of the imaging media can be selectively presented to the pick roller for picking.

That is, in accordance with one embodiment of the present invention, an imaging apparatus includes a first media tray configured to hold a first imaging media, and a second media tray configured to hold a second imaging media. The imaging apparatus also comprises a pick roller configured to selectively pick the first imaging media from the first media tray and the second media from the second media tray. In other words, the single pick roller is configured to selectively pick media from either the first media tray or the second media tray, one tray at a time. The movement of the first and second media trays can be facilitated by way of an actuating mechanism that is configured to control the movement of the first and second media trays relative to the pick roller.

In accordance with another embodiment of the present invention, an imaging apparatus includes a first media tray configured to hold a first imaging media, and a second media tray configured to hold a second imaging media. A pick roller is also included in the imaging apparatus, wherein the first media tray is configured to slide relative to the second media tray to facilitate selective presentation of the first imaging media and the second imaging media, one-at-a-time, to the pick roller for picking. An actuating mechanism can also be included, wherein the actuating mechanism is configured to control the movement of the first and second media trays relative to the pick roller.

Another imaging apparatus, in accordance with an embodiment of the present invention, includes a first media tray that has a first lift plate pivotally mounted to it, and wherein a first imaging media is supported on the first lift plate. Likewise, a second media tray is included that has a second lift plate pivotally mounted to it, wherein the second imaging media is supported on the second lift plate. An actuating mechanism can be included as well, wherein the actuating mechanism is configured to cause the first media tray to slide in a direction opposite of that of the second media tray. A lifting device is provided to contact the first and the second lifting plates, one-at-a-time, and to cause to pivot, the respective first and second lift plates. Such pivoting of the first and second lift plates results in presentation of the first and second imaging media, respectively, to a single pick roller on a selective basis.

In accordance with yet another embodiment of the present invention, a method of using a first imaging media and a second imaging media in an imaging device having a single pick roller includes supporting the first and the second imaging media on the imaging device simultaneously. The method also includes picking the first imaging media with the pick roller while the first and second media are simultaneously supported on the imaging device, and also includes picking the second imaging media with the pick roller while the first and second imaging media are simultaneously supported on the imaging device.

Turning now to FIG. 1, a schematic diagram is shown which depicts an imaging apparatus 100 in accordance with one embodiment of the present invention. The imaging apparatus comprises a first media tray 101 that is configured to hold a first imaging media M1. The imaging apparatus 100 also includes a second media tray 102 that is configured to hold a second imaging media M2.

A pick roller 120 is also included in the imaging apparatus 100. The pick roller 120 is configured to selectively pick the first imaging media M1 from the first media tray 101, and is also configured to pick the second media M2 from the second media tray 102. That is, the single pick roller 120 is configured to pick both the first imaging media M1 and the second imaging media M2 from the first and second media trays 101 and 102, respectively.

Figure 2:
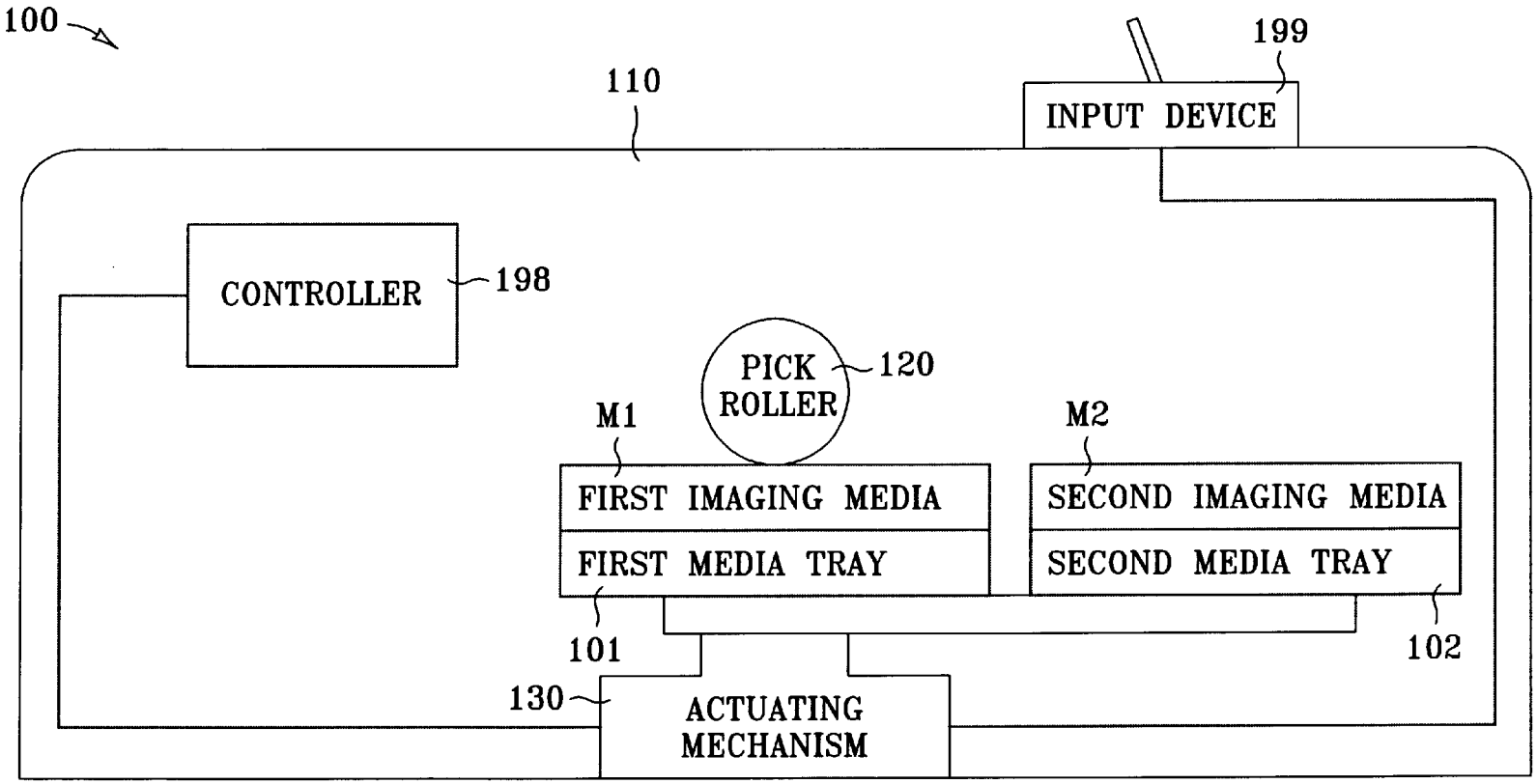
FIG. 2 is a schematic diagram which depicts the imaging apparatus shown in FIG. 1, with the first and second media trays shown in different positions relative to the pick roller.

Turning now to FIG. 2, another schematic diagram is shown which depicts the imaging apparatus 100 shown in FIG. 1. With reference now to both FIGS. 1 and 2, the use of the single pick roller 120 to pick the first and second imaging medias M1 and M2 is preferably facilitated by way of an actuating mechanism 130 that can be included in the imaging apparatus 100. The actuating mechanism 130 is connected to the first media tray 101, and can also be connected to the second media tray 102.

The actuating mechanism 130 is configured to cause the first media tray 101 and the second media tray 102 to be positioned, one-at-a-time, relative to the pick roller 120 to thereby present the first imaging media M1 and the second imaging media M2, respectively, to the pick roller for picking. That is, the actuating mechanism is configured to alternately present either the first imaging media M1 or the second imaging media M2 to the pick roller 120 for picking.

In other words, at any given point in time, either the first media tray 101 or the second media tray 102 is positioned so that either first imaging media M1 or the second imaging media M2, respectively, is presented to the pick roller 120 for picking. For example, it can be assumed that, at a certain point in time, the first media tray 101 is positioned relative to the pick roller 120 so that the first imaging media M1 is presented to the pick roller for picking. The first media tray 101 thus remains at this position while the pick roller 120 picks the required quantity of first imaging media M1 from the first media tray.

When the second imaging media M2 is needed at the pick roller 120 for picking, the actuating mechanism 130 is actuated so as to position the second media tray 102 relative to the pick roller so that the second imaging media is presented to the pick roller for picking. When the pick roller 120 finishes picking the required quantity of the second imaging media M2, and when the first imaging media M1 is required at the pick roller for picking, the actuating mechanism 130 is actuated so as to position the first media tray 101 relative to the pick roller so that the first imaging media is presented to the pick roller for picking.

The actuating mechanism 130 can be configured to automatically change the positions of the first and second media trays 101 and 102 by way of an actuator (not shown) or the like, so as to alternately present the first imaging media M1 and the second imaging media M2 to the pick roller for picking. That is, the first imaging media M1 and the second imaging media M2 can be configured to be selectively alternately presented by the actuating mechanism to the pick roller 120 for picking in an automatic fashion by way of an actuator or the like (not show). Examples of how such an actuator can be so employed in conjunction with the present invention will be discussed below with regard to other embodiments of the present invention.

The imaging apparatus 100 can also include a controller 198 which is configured to automatically control the actuation of the actuating mechanism 130 in response to predetermined criteria. The predetermined criteria can be, for example, a signal from a host device (not shown) such as a personal computer or the like, to switch from one imaging media to the other. For example, in the case wherein the predetermined criteria is a signal from a personal computer, the signal can originate in a word processing program, wherein a specific type of imaging media is specified thereby.

More specifically, for example, a word processing program operating in a personal computer host device can generate a signal which is sent to the controller 198, wherein the signal specifies a change from the first imaging media M1 to the second imaging media M2. Such a situation can arise in a case wherein a document is first printed on standard sheet media, and then an address is to be printed on envelope media.

In such a case, and by way of example only, predetermined criteria in the form of a signal originating from the word processing program is received by the controller 198. In response, the controller 198 automatically controls the actuating mechanism 130 so as to present the standard sheet media (e.g. first imaging media M1) to the pick roller 120 for picking while the document is printed.

This is accomplished by causing the actuating mechanism 130 to position the respective media tray (e.g. first media tray 101) relative to the pick roller 120. When the required quantity of standard sheet media is picked by the pick roller 120, the controller 198 controls the actuating mechanism 130 so as to then present the envelope media (e.g. second imaging media M2) to the pick roller 120 for picking while the address is printed on the envelope. When the required quantity of envelope media is picked by the pick roller 120, and when the standard sheet media is again required at the pick roller, the controller 130 again repositions the first and second media trays 101 and 102 so that the standard sheet media is again presented to the pick roller 120 for picking.

Such control of the actuating mechanism 130 to alternately position the first and second media trays 101 and 102 relative to the pick roller 120 can alternatively, or additionally, be accomplished manually by way of an input device 199. That is, the imaging apparatus 100 can comprise an input device 199 either in addition to, or as an alternative to, the controller 198. The input device 199 is configured to control the actuation of the actuating mechanism in response to an input from an operator of the imaging apparatus 100. For example, the input device 199 can be in the form of a switch or the like (not shown), which the operator can manipulate so as to position the first and second media trays 101 and 102 relative to the pick roller 120 in order to present the desired first or second imaging media M1 and M2 to the pick roller for picking.

In such a case, the operator can print a plurality of documents on the second imaging media M2 by first positioning the second media tray 102 relative to the pick roller 120 so that the second imaging media is presented to the pick roller for picking, as is shown in FIG. 1. The operator can then manipulate the input device 199 so that the actuating mechanism 130 changes the positions of the first and second media trays 101 and 102 to thereby present the first imaging media M1 to the pick roller 120 for picking. The operator can then print a plurality of documents on the first imaging media M1.

As is seen from a study of FIGS. 1 and 2, the imaging apparatus 100 can be configured so that the first media tray 101 and the second media tray 102 remain substantially parallel to one another. However, it is understood that the present invention is not intended to limit the first and second media trays 101 and 102 to being parallel to one another. Also, although the first and second media trays 101 and 102 are shown to be substantially aligned with one another, it is understood that the present invention is not intended to limit the first and second media trays to being aligned with one another, as will become apparent in later discussion.

Figure 3:
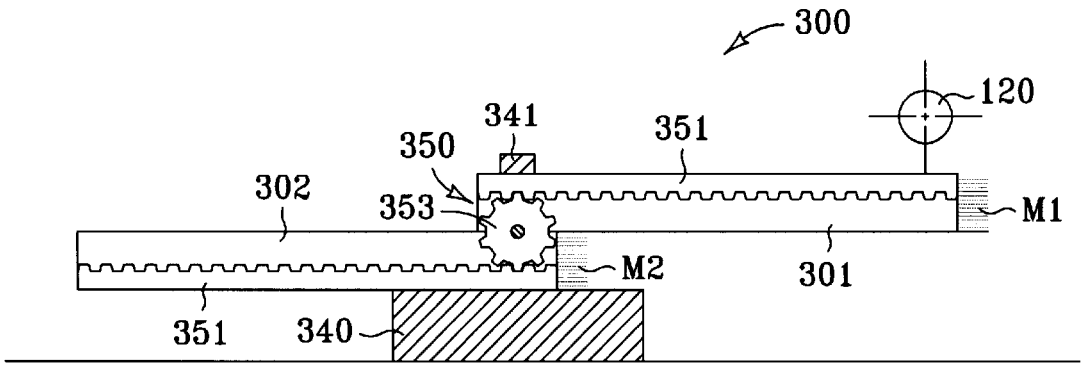
FIG. 3 is a side elevation sectional view of an imaging apparatus in accordance with another embodiment of the present invention, with some components not shown.

Moving now to FIG. 3, a side elevation sectional view is shown which depicts an imaging apparatus 300 in accordance with another embodiment of the present invention. The imaging apparatus 300 comprises a first media tray 301 that is configured to hold the first imaging media M1. The imaging apparatus 300 also comprises a second media tray 302 that is configured to hold the second imaging media M2. As shown, the first imaging media M1 and the second imaging media M2 can each comprise a plurality of sheets of respective imaging media so as to form respective stacks of imaging media that are supported on the respective first and second media trays 301 and 302.

The imaging apparatus 300 also comprises a pick roller 120 which is described above with respect to the imaging apparatus 100 which is shown in FIGS. 1 and 2. As is further shown, the imaging apparatus 300 preferably comprises a chassis 340 on which the remainder of the apparatus can be supported. A frame 341 is also preferably included in the apparatus 300, and is more preferably supported on the chassis. The frame 341 and the chassis 340 are preferably configured to remain stationary relative to the pick roller 120. Furthermore, the frame 341 and the chassis 340 together can act to stabilize the first and the second media trays 301 and 302 as the trays move relative to the pick roller 120. That is, the frame 341 preferably acts to maintain the functional alignment of the first and second media trays 301 and 302.

As further shown in FIG. 3, the first media tray 301 and the second media tray 302 are each preferably configured to function similarly to the first and second media trays 101 and 102 of the apparatus 100 which is described above and shown in FIGS. 1 and 2. That is, the pick roller 120 is configured to selectively pick the first imaging media M1 from the first media tray 301, and is further configured to pick the second imaging media M2 from the second media tray 302, wherein respective imaging media is picked from one tray at a time.

Preferably, the first media tray 301 of the imaging apparatus 300 is slidably disposed upon the second media tray 302 of the apparatus. Accordingly, the first media tray 301 is configured to slide relative to the second media tray in order to facilitate selective presentation of the first imaging media M1 and the second imaging media M2, one-at-atime, to the pick roller for picking. That is, in the manner described above with respect to the imaging apparatus 100, the imaging apparatus 300 is configured so that the first media tray 301 and the second media tray 302 can be positioned, one-at-a-time relative to the pick roller 120 to thereby present the first media M1 and the second media M2, respectively, to the pick roller for picking.

In order to facilitate the alternate presentation of the first imaging media M1 and the second imaging media M2 to the pick roller 120, the imaging apparatus 300 preferably comprises an actuating mechanism 350. The actuating mechanism 350 comprises a gear rack 351 that is supported on the first media tray 301. The actuating mechanism 350 also comprises a pinion gear 353 that is meshingly engaged with the gear rack 351. As is seen from a study of FIG. 3, the rotation of the pinion gear 353 causes the first media tray 301 to slide relative to the second media tray 302.

Figure 4:
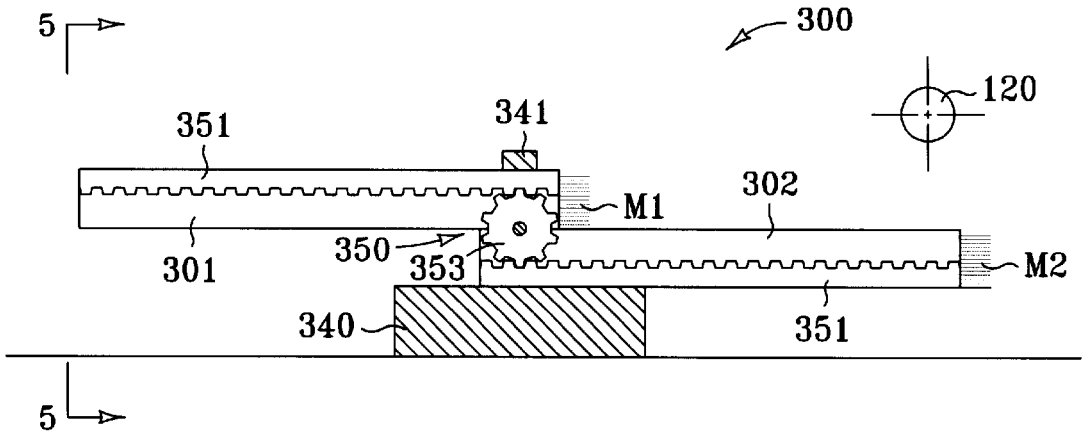
FIG. 4 is a side elevation sectional view of the imaging apparatus shown in FIG. 3, with the first and second media trays shown in different positions relative to the pick roller.

Turning now to FIG. 4, another side elevation sectional view is shown which depicts the imaging apparatus 300 that is shown in FIG. 3. It is evident that FIGS. 3 and 4 are identical, with the exception that the first and second media trays 301 and 302 are shown in opposite positions relative to the pick roller 120. As is also seen, the actuating mechanism 350 preferably comprises a pair of gear racks 351, wherein one of the gear racks is supported on the first media tray 301, and the other of the gear racks is supported on the second media tray 302. Accordingly, the pinion gear 353 is preferably meshingly engaged with each of the gear racks 351.

It is understood from a study of FIGS. 3 and 4, that an operator can manipulate the first and second media trays 301 and 302 so as to selectively and alternatively position each media tray relative to the pick roller 120 so that either the first media M1 or the second media M2 is presented to the pick roller for picking. That is, in accordance with the present invention, the first and/or second media trays 301 and 302 can be moved manually by an operator so as to selectively position either the first media tray 301 or the second media tray 302 at the pick roller 120 so as to present either the first media M1 or the second media M2 to the pick roller for picking.

Figure 5:
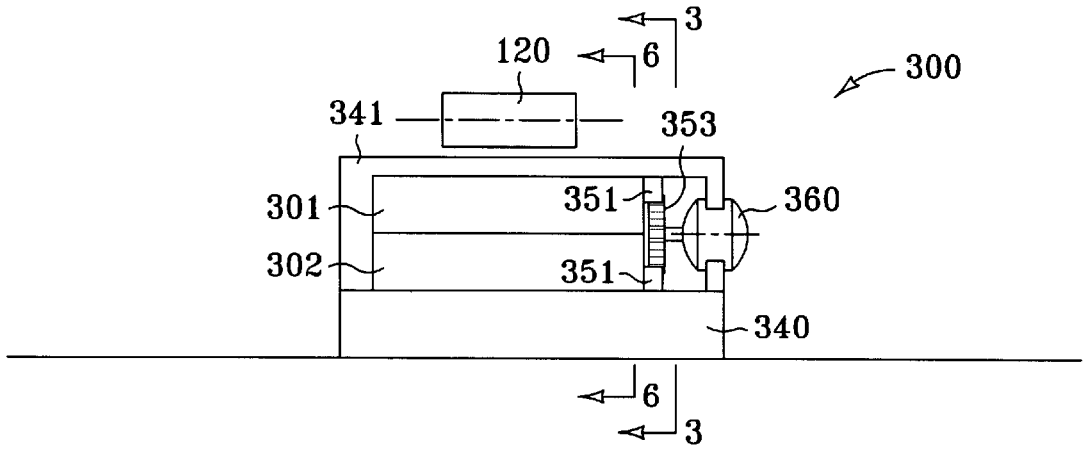
FIG. 5 is an end view of the imaging apparatus shown in FIGS. 3 and 4.

Turning now to FIG. 5, an end view is shown of the apparatus 300 which is shown in FIGS. 3 and 4. As is seen in FIG. 5, the imaging apparatus 300 preferably comprises an actuator 360 that is configured to cause the pinion gear 353 to rotate. The actuator 360 can be, for example, a rotary actuator such as a stepper motor or the like. As is also seen, the frame 341 and the chassis 340 preferably surround both the first and second media trays 301 and 302 so as to stabilize the trays during movement thereof. It is understood that, for reasons of clarity, FIGS. 3 through 5 show only a portion of the components that are contemplated for inclusion into the imaging apparatus 300, and that other components will be described below with reference to additional figures.

Returning now to FIGS. 3 and 4, it is seen that, rotation of the pinion gear 353 in a first direction causes the first media tray 301 to move toward the pick roller 120, while rotation of the pinion gear in a second direction opposite the first direction causes the first media tray to move away from the pick roller. Likewise, rotation of the pinion gear 353 in the first direction can cause the second media tray 302 to move away from the pick roller 120, while rotation of the pinion gear in the second direction can cause the second media tray to move toward the pick roller.

Figure 6:
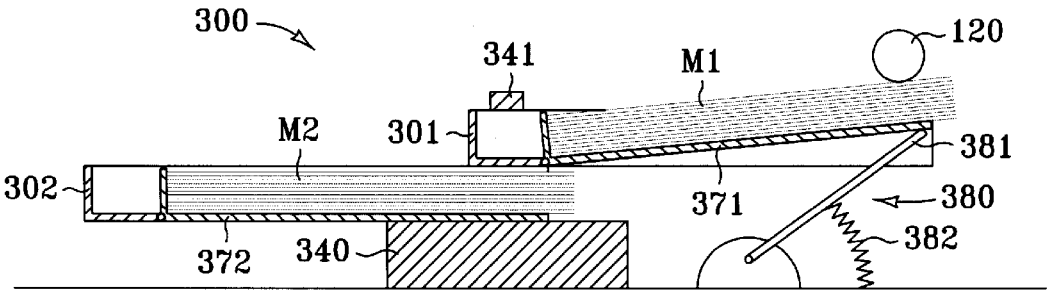
FIG. 6 is a side elevation sectional view of the imaging apparatus shown in FIGS. 3 through 5, with additional components shown.
Figure 7:
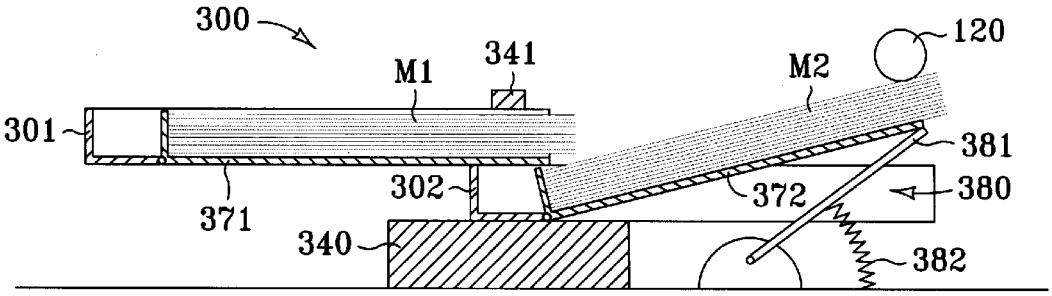
FIG. 7 is a side elevation sectional view of the imaging apparatus shown in FIG. 6, with the first and second media trays shown in different positions relative to the pick roller.

Turning now to FIGS. 6 and 7, respective side elevation sectional views are shown of the imaging apparatus 300 that is depicted in FIGS. 3 through 5. As is evident from an examination of FIGS. 6 and 7, additional components of the apparatus 300 are shown which are omitted from FIGS. 3 through 5 for reasons of clarity, as explained above. It is also understood that other components of the imaging apparatus 300 which are described above and shown in FIGS. 3 through 5 have been omitted from FIGS. 6 and 7 for reasons of clarity.

With reference to FIGS. 6 and 7, the imaging apparatus 300 can additionally comprise a first lift plate 371 that is configured to support thereon the first imaging media M1. The first lift plate 371 is pivotally connected to the first media tray 301 so as to be pivotable relative thereto as shown. Likewise, the imaging apparatus 300 can also comprise a second lift plate 372 that is configured to support thereon the second imaging media M2. Similarly, the second lift plate 372 is pivotally connected to the second media tray 302 so as to be pivotable relative thereto as is also shown.

The apparatus 300 preferably comprises a lifting device 380 positioned as shown relative to the pick roller 120 and to the first and second media trays 301 and 302. The lifting device 380 is configured to cause the first lift plate 371 and the second lift plate 372 to pivot, one-at-a-time, relative to the first media tray 301 and to the second media tray 302, respectively, in order to facilitate presentation of the first imaging media M1 and the second imaging media M2, respectively, to the pick roller 120 for picking. The lifting device 380 preferably comprises a lifting member 381 that is configured to pivot relative to the first and second media trays 301 and 302. The lifting device 380 also preferably comprises a biasing member 382 configured to contact the lifting member 381 and to thereby urge the lifting member toward the first lift plate 371 and toward the second lift plate 372 to facilitate pivoting thereof by the lifting member.

It is understood that the lifting device 380 can be a passive lifting device or an active lifting device. That is, the lifting device 380 can be configured to perform passively, wherein the biasing member 382 is a resilient member such as a spring or the like. In such a passively operational configuration, the lifting device 380 depends upon the movement of the first and second media trays 301 and 302 there against in order to perform its function. Alternatively, the lifting device 380 can be configured to perform actively, wherein the biasing member 382 is an actively controlled actuator or the like. In such an actively operational configuration, the lifting device functions actively in response to a signal from a controller or the like, such as the controller 198 shown in FIGS. 1 and 2.

Thus, as shown in FIG. 6, wherein the lifting device 380 is configured to operate passively, it is seen that the movement of the first media tray 301 toward the pick roller 120 causes the first lift plate 371 to contact the lifting member 381, and to thereby pivot so as to present the first media M1 to the pick roller 120. Likewise, as shown in FIG. 7, movement of the second media tray 302 toward the pick roller 120 causes the second lift plate 372 to contact the lifting member 381, and to thereby pivot so as to present the second media M2 to the pick roller 120.

It is also seen, with reference to FIGS. 3 and 4 as well as FIGS. 6 and 7, that rotation of the pinion gear 353 in a first direction causes the first imaging media M1 to be presented to the pick roller 120, while rotation of the pinion gear in a second direction opposite the first direction causes the second imaging media M2 to be presented to the pick roller 120. As explained above, such rotation of the pinion gear 353 can be caused by manual movement by an operator of the first and/or second media trays 301 and 302, or by automatic rotation of the pinion gear by way of the actuator 360.

Figure 8:
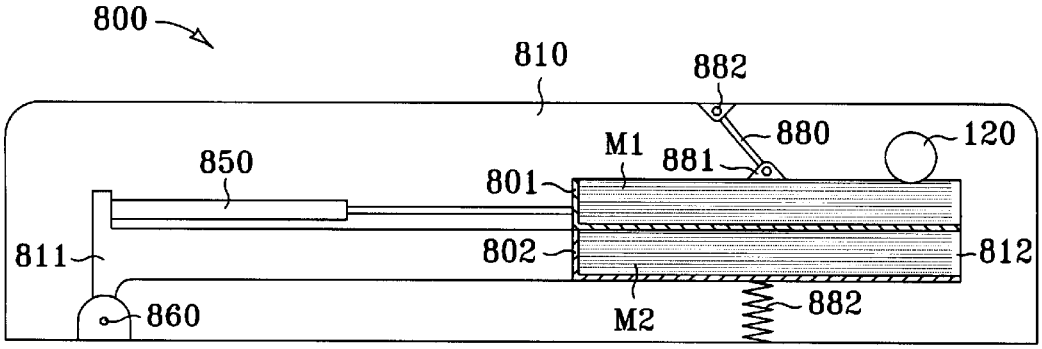
FIG. 8 is a side elevation view of an imaging apparatus in accordance with yet another embodiment of the present invention.
Figure 9:
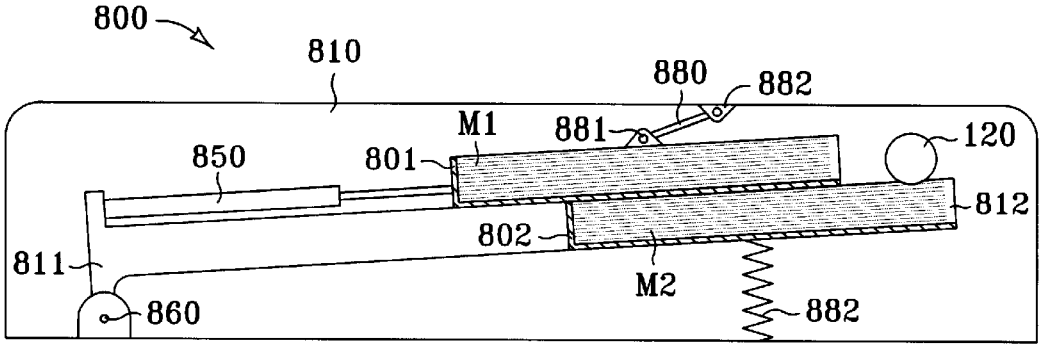
FIG. 9 is a side elevation view of the imaging apparatus shown in FIG. 8, with the first and second media trays shown in different positions relative to the pick roller.

Now moving to FIGS. 8 and 9, respective side elevation views are shown in which an imaging apparatus 800 is depicted in accordance with yet another embodiment of the present invention. The imaging apparatus 800 comprises a first media tray 801 configured to hold the first imaging media M1. A second media tray 802 is also included in the imaging apparatus 800, wherein the second media tray is configured to hold a second imaging media M2. The imaging apparatus also comprises a pick roller 120 that is configured to selectively pick the first imaging media M1 from the first media tray 801, and the second imaging media M2 from the second media tray 802, wherein the respective media is picked from one tray at a time.

The imaging apparatus 800 also preferably comprises an actuating mechanism 880 that is connected to the first media tray 801. The actuating mechanism 880 is preferably configured to cause the first media tray 801 and the second media tray 802 to be positioned, one-at-a-time, relative to the pick roller 120 to thereby present the first imaging media M1 and the second imaging media M2 to the pick roller for picking. That is, the imaging apparatus 800 is configured to selectively alternately present the first imaging media M1 and the second imaging media M2 to the pick roller.

Preferably, the apparatus 800 also comprises a chassis 810 that is configured to serve as a structural support for one or more components of the apparatus. The pick roller 120 is preferably operationally supported on the chassis 810 as shown. The second media tray 802 is also preferably movably supported on the chassis 810, while the first media tray 801 is slidably supported on the second media tray. That is, the first media tray 801 is preferably supported on the second media tray 802 so as to slide relative thereto as suggested by an examination of both FIGS. 8 and 9.

Mores pacifically, sliding the first media tray 801 in a first direction relative to the second media tray 802 results in presentation of the first imaging media to the pick roller for picking. Likewise, sliding the first media tray 801 in a second direction, which is opposite of the first direction, results in presentation of the second imaging media M2 to the pick roller 120 for picking.

A pivot axis 860 can be defined on the second media tray 802, as shown. The second media tray 802 can thus be pivotally connected to the chassis 810 and thereby configured to pivot about the pivot axis 860. As is seen from a study of both FIGS. 8 and 9, movement of the first media tray 801 relative to the second media tray 802 causes the second media tray to pivot about the pivot axis 860. This pivoting of the second media tray 802 as the result of movement relative thereto of the first media tray 801 can be achieved by way of the operation of the actuating mechanism 880.

Preferably, the actuating mechanism 880 is in the form of an elongated member, as shown. The actuating mechanism 880, in the form of an elongated member, has a first end 881 that is pivotally connected to the first media tray 801, and a distal opposite second end 882 that is pivotally connected to the chassis 810. Thus, as is seen from an examination of both FIGS. 8 and 9, the actuating mechanism 880 causes the first media tray 801, when sliding relative to the second media tray 802, to move in a substantially arcuate manner about the second end 882 and relative to the chassis 810.

It is understood that the actuating mechanism 880 can be configured in any of several possible manners. For example, as an alternative to the configuration of the actuating mechanism 880 which is described above and shown in FIGS. 8 and 9, the actuating mechanism can comprise a cam surface (not shown) and a cam follower (not shown). More specifically, in such an alternative configuration, the cam surface can be supported or defined on the chassis 810. Likewise, the cam follower can be mounted on the first media tray 801 and configured to follow the cam surface as the result of movement of the first media tray relative to the second media tray 802.

As a view of FIGS. 8 and 9 reveals, the second media tray 802 can have a first end 811 and an opposite distal second end 812. The second imaging media M2 is preferably positioned proximate the second end 812 as shown, while the pivot axis 860 is preferably defined proximate the first end 811. As is also revealed from a study of FIGS. 8 and 9, movement of the first media tray 801 toward the second end of the second media tray 802 results in the presentation of the first media M1 to the pick roller 120, while movement of the first media tray toward the first end 811 of the second media tray results in presentation of the second media M2 to the pick roller. As is further seen, the first media tray 801 and the second media tray 802 preferably remain substantially parallel to one another.

The imaging apparatus 800 preferably comprises a biasing member 882 which is connected between the chassis 810 and the second media tray 802. The biasing member 882 is preferably configured to bias the second media tray 802 toward the pick roller 120. The imaging apparatus 800 also preferably comprises an actuator 850. The actuator 850 is preferably connected to the first media tray 801 and is configured to selectively cause the first media tray to slide relative to the second media tray 802 to facilitate presentation of the first media M1 and the second media M2, one-at-a-time, to the pick roller 120 for picking. It is understood that the actuator 850 can have one of many possible alternative positions and configurations other than that specifically shown.

As shown, the actuator 850 can be in the form of a linear actuator as shown, which can include, for example, a hydraulic or pneumatic cylinder assembly, a linear motor, or the like. The actuator 850, when configured as a linear actuator, can be connected between the first media tray 801 and the second media tray 802 as shown. Alternatively, the actuator 850, when configured as a linear actuator, can be connected, by way of pivot connections (not shown), between the first media tray 801 and the chassis 810.

As yet a further alternative, the actuator 850 and the actuating mechanism 880 can be integrated with one another. For example, the actuating mechanism 880 can be alternatively replaced by a rotary actuator (not shown) connected between the chassis 810 and the first media tray 801, and which is configured to serve as both the actuating device as well as the actuator to move the first media tray relative to the second media tray 802.

In accordance with yet another embodiment of the present invention, a method of using a first imaging media and a second imaging media in an imaging apparatus having a pick roller is disclosed. The method includes supporting the first imaging media and the second imaging media on the imaging apparatus simultaneously. While the first imaging media and the second imaging media are supported simultaneously on the imaging apparatus, the first imaging media is picked by the pick roller. Likewise, the second imaging media is also picked by the pick roller while the first imaging media and the second imaging media are supported simultaneously on the imaging apparatus.

That is, while the first imaging media and the second imaging media are supported on the imaging apparatus, the first imaging media is presented to the pick roller for picking by moving the first imaging media into contact with the pick roller. When the second imaging media is to be picked, the first imaging media is moved out of contact with the pick roller, and the second imaging media is presented to the pick roller by moving the second imaging media into contact with the pick roller.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An imaging apparatus, comprising:

a first media tray configured to hold a first imaging media;

a second media tray configured to hold a second imaging media, wherein the first media tray is slidably disposed upon the second media tray; and, a pick roller, wherein the first media tray is configured to slide relative to the second media tray to facilitate selective presentation of the first imaging media and the second imaging media, one-at-a-time, to the pick roller for picking;

a pair of gear racks, wherein one of the gear racks is supported on the first media tray and the other of the gear racks is supported on the second media tray; and, a pinion gear meshingly engaged with both of the gear racks, wherein rotation of the pinion gear in a first direction causes the first imaging media to be presented to the pick roller, and rotation of the pinion gear in a second direction opposite the first direction causes the second imaging media to be presented to the pick roller.

2. An imaging apparatus, comprising:

a first media tray having a first lift plate pivotally mounted thereto, wherein the first lift plate is configured to support thereon a first imaging media;

a second media tray having a second lift plate pivotally mounted thereto, wherein the second lift plate is configured to support thereon a second imaging media, wherein the first media tray is slidably mounted on the second media tray and configured to slide relative thereto;

an actuating mechanism configured to control movement of the first media tray relative to the second media tray;

a lifting device comprising a lifting member and a biasing member, wherein the lifting member is biased toward the first and second lifting plates by the biasing member to thereby contact the first lift plate and the second lift plate, one-at-a-time, and as the result of movement of the first media tray relative to the second media tray, wherein such contact of the lifting member with the first lifting plate and the second lifting plate results in pivoting of the first lifting plate and the second lifting plate, respectively; and, a pick roller, wherein the pivoting of the first lift plate and the second lift plate results in presentation of the first imaging media and the second imaging media, respectively, one-at-a-time, to the pick roller for picking.

3. The imaging apparatus of claim 2, wherein the actuating mechanism comprises:

a pair of gear racks, wherein one of the gear racks is supported on the first media tray and the other of the gear racks is supported on the second media tray;

a pinion gear meshingly engaged with each of the gear racks, wherein:

rotation of the pinion gear causes the first media tray to slide relative to the second media tray;

rotation of the pinion gear in a first direction causes the first imaging media to be presented to the pick roller; and, rotation of the pinion gear in a second direction opposite of the first direction causes the second imaging media to be presented to the pick roller.

4. An imaging apparatus, comprising:

a chassis;

a pick roller operationally supported on the chassis;

a first media tray configured to hold a first imaging media;

an actuating mechanism operatively connected between the chassis and the first media tray; and, a second media tray movably supported on the chassis, and configured to hold a second imaging media, wherein:

the first media tray is slidably supported on the second media tray;

the first media tray is slidable in a first direction relative to the second media tray;

the first media tray is slidable in a second direction relative to the second media tray;

sliding of the first media tray in the first direction results in presentation of the first imaging media to the pick roller for picking; and, sliding of the first media tray in the second direction results in presentation of the second imaging media to the pick roller for picking.

5. The imaging apparatus of claim 4, and wherein:

a pivot axis is defined on the second media tray;

the second media tray is pivotally connected to the chassis and thereby configured to pivot about the pivot axis; and, movement of the first media tray relative to the second media tray causes the second media tray to pivot about the pivot axis.

6. The imaging apparatus of claim 4, and wherein:

the second media tray has a first end and an opposite distal second end;

the second imaging media is positioned proximate the first end of the second media tray;

the first media tray, when sliding in the first direction, moves toward the first end of the second media tray; and, the first media tray, when sliding in the second direction, moves toward the second end of the second media tray.

7. The imaging apparatus of claim 5, and wherein:

the second media tray has a first end and an opposite distal second end;

the second imaging media is positioned proximate the first end of the second media tray;

the pivot axis is positioned proximate the second end of the second media tray;

the first media tray, when sliding in the first direction, moves toward the first end of the second media tray; and, the first media tray, when sliding in the second direction, moves toward the second end of the second media tray.

8. The imaging apparatus of claim 7, and further comprising an actuator that is configured to cause the second media tray to move relative to the first media tray.

9. The imaging apparatus of claim 4, and wherein the actuating mechanism is substantially in the form of an elongated member having a first end pivotally connected to the first media tray, and a distal opposite second end pivotally connected to the chassis, wherein operation of the actuating mechanism causes the first media tray to move in a substantially arcuate manner relative to the chassis.

10. The imaging apparatus of claim 4, and wherein the first media tray and the second media tray remain substantially parallel to one another.

11. The imaging apparatus of claim 4, and further comprising a biasing member connected between the chassis and the second media tray, and configured to bias the second media tray toward the pick roller.

* * * * *